US007896438B2

(12) United States Patent
Whelan et al.

(10) Patent No.: US 7,896,438 B2
(45) Date of Patent: Mar. 1, 2011

(54) SHAPEABLE WHEELCHAIR SEATBACK ASSEMBLY

(75) Inventors: Thomas J. Whelan, Longmont, CO (US); James L. Christofferson, Longmont, CO (US)

(73) Assignee: Sunrise Medical HHG, Inc., Longmont, CO (US)

( * ) Notice: Subject to any disclaimer, the term of this patent is extended or adjusted under 35 U.S.C. 154(b) by 171 days.

(21) Appl. No.: 11/904,118

(22) Filed: Sep. 26, 2007

(65) Prior Publication Data

US 2008/0079298 A1 Apr. 3, 2008

Related U.S. Application Data

(60) Provisional application No. 60/848,343, filed on Sep. 29, 2006.

(51) Int. Cl.
*A47C 3/00* (2006.01)

(52) U.S. Cl. ..... 297/284.4; 297/440.15; 297/353; 297/383

(58) Field of Classification Search ..... 297/440.15, 297/284.4, 284.1, 284.2, 284.9, 452.37, 353, 297/344.15, 383, 408
See application file for complete search history.

(56) References Cited

U.S. PATENT DOCUMENTS

| | | | | | |
|---|---|---|---|---|---|
| 3,899,209 | A | * | 8/1975 | Schulz | 297/383 |
| 3,941,417 | A | * | 3/1976 | Re | 297/85 |
| 4,153,293 | A | | 5/1979 | Sheldon | |
| 4,368,917 | A | | 1/1983 | Urai | |
| 4,636,000 | A | * | 1/1987 | Nishino | 297/284.9 |
| 4,763,951 | A | * | 8/1988 | Silverman | 297/440.15 |
| 4,792,185 | A | * | 12/1988 | Oshikawa | 297/284.11 |
| 4,856,846 | A | | 8/1989 | Lohmeyer | |
| 5,364,162 | A | * | 11/1994 | Bar et al. | 297/284.8 |
| 5,718,476 | A | * | 2/1998 | De Pascal et al. | 297/284.4 |
| D413,841 | S | * | 9/1999 | Bar et al. | D12/133 |
| 6,095,611 | A | | 8/2000 | Bar | |
| 6,257,664 | B1 | * | 7/2001 | Chew et al. | 297/284.9 |
| 6,378,942 | B1 | | 4/2002 | Chu | |
| 6,695,378 | B2 | * | 2/2004 | Hanagan | 296/65.01 |
| 6,913,318 | B2 | * | 7/2005 | Higley et al. | 297/383 |
| 7,032,971 | B2 | | 4/2006 | Williams | |
| 7,458,637 | B2 | * | 12/2008 | Norman et al. | 297/284.4 |
| 2003/0102706 | A1 | * | 6/2003 | Float et al. | 297/440.2 |
| 2004/0124679 | A1 | | 7/2004 | Teppo | |
| 2004/0245823 | A1 | | 12/2004 | Ligon | |

FOREIGN PATENT DOCUMENTS

| | | |
|---|---|---|
| WO | WO 96/07344 | 3/1996 |
| WO | WO 02/28339 | 4/2002 |

OTHER PUBLICATIONS

Schukra Lumbar System, Mar. 24, 2006, www.schukra.com.

* cited by examiner

*Primary Examiner*—David Dunn
*Assistant Examiner*—Erika Garrett
(74) *Attorney, Agent, or Firm*—MacMillan, Sobanski & Todd, LLC

(57) ABSTRACT

The present invention is directed toward a seatback assembly that includes a backrest comprising shapeable material and an adjustable support, the backrest being attached to the adjustable support, the adjustable support being adjustable to alter the curvature of the backrest from top to bottom and then fix the backrest in place, thus shaping the backrest.

20 Claims, 5 Drawing Sheets

SHAPEABLE WHEELCHAIR SEATBACK ASSEMBLY

CROSS-REFERENCE TO RELATED APPLICATIONS

This application claims the benefit of U.S. Provisional Application No. 60/848,343, filed Sep. 29, 2006, the disclosure of which is incorporated herein by reference.

BACKGROUND OF INVENTION

The present invention generally relates to wheelchairs and, more particularly, to wheelchair seat systems which are adaptable to the anatomical structure of the user and/or adjustable to achieve support-related objectives for a given user.

In general, wheelchair seat systems include cushions that are constructed from flexible material. However, the flexible material does not provide optimum support or comfort for the user. Foam and air filled seat cushions have been developed to provide improved support for users requiring special support, such as paraplegics or users having spinal deformities or muscular atrophy, but these seat cushions are difficult to adjust to accommodate specific needs and proportions of individual users and do not encourage proper control of body position. Furthermore, users often become oversensitive to pressures against their skin and bodies so that it is desirable to develop a support cushion that exerts low pressures against a user's body and skin.

What is needed is a seat system that not only conforms to the shape of the user's body, but also provides stabilizing forces that allow for postural control. Such a seat system should provide a stable platform to permit improved control of body position and posture. Furthermore, such a seat system must be durable and able to withstand extensive use for extended periods of time.

SUMMARY OF INVENTION

The present invention is directed toward a seatback assembly that includes a backrest comprising shapeable material and an adjustable support, the backrest being attached to the adjustable support, the adjustable support being adjustable to alter the curvature of the backrest from top to bottom and then fix the backrest in place, thus shaping the backrest.

DETAILED DESCRIPTION

Figure 1:
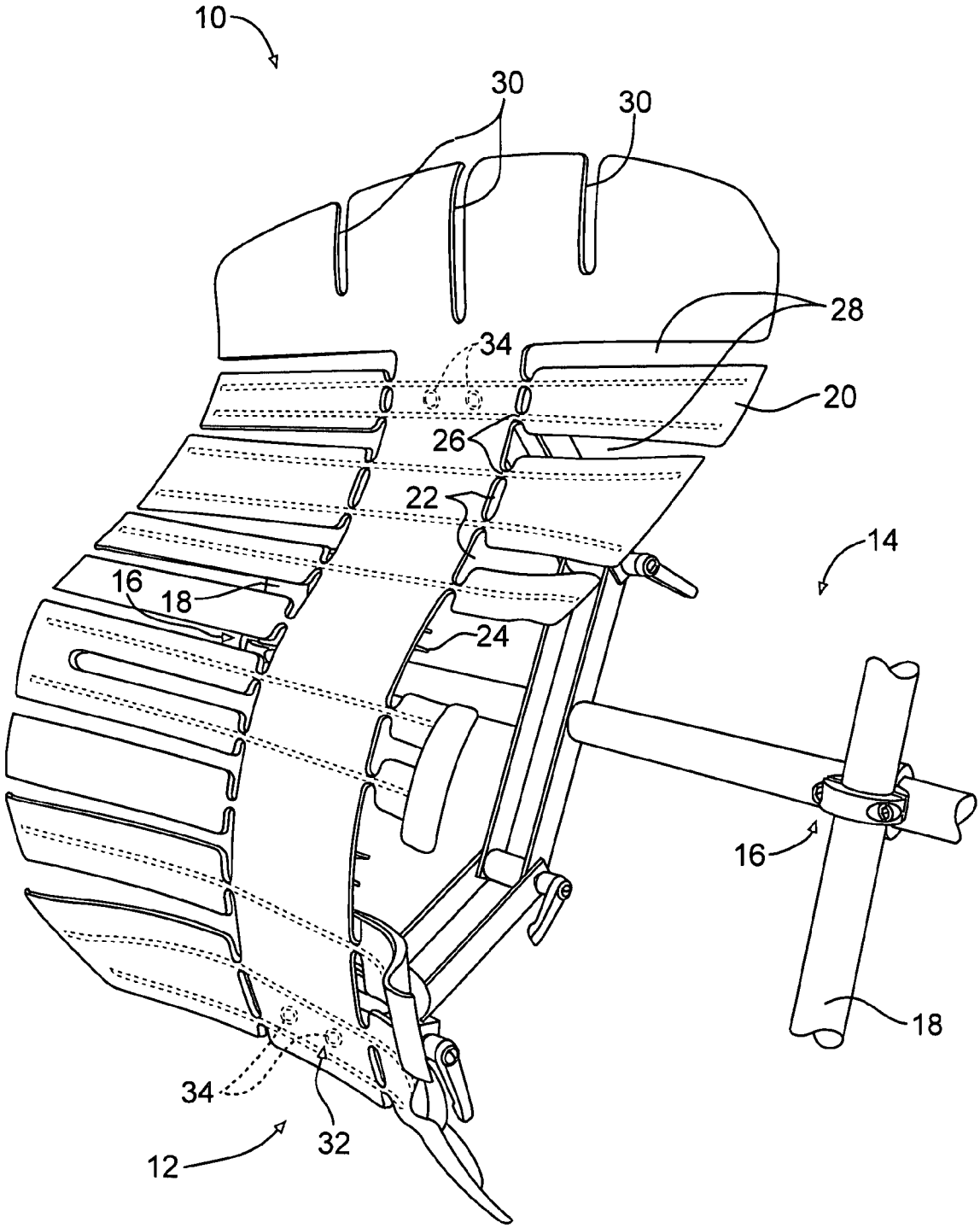
FIG. 1 is a partially cutaway front perspective view of a shapeable wheelchair seatback assembly having an exemplary backrest with wings, ribs and slots that promote backrest flexibility and the shapeability of the seatback assembly.

Referring now to the drawings, there is a perspective view in FIG. 1 of a seatback assembly, generally indicated at 10, having a backrest 12, an adjustable support 14 and a coupling 16 for attaching the seatback assembly 10 to a rigid support 18.

An example of a backrest 12 is described in U.S. Pat. No. 7,032,971, the disclosure of which is hereby incorporated by reference into this specification. The backrest 12 may be of molded plastics, such as nylon, and may have the general shape of a shield bowed in a forward direction (when viewed in vertical section) and may have side wings 20 curving further in a forward direction. There may be two closed end slots 22 extending vertically and symmetrically, one proximate each side of a vertical center line and stopping short of the top and bottom edges of the backrest 12. There could be thin webs or membranes or other suitable structure, instead of the slots 22, making narrow zones of weakness, but for ease of manufacture slots may be preferred.

Reinforcing ribs 24 may extend horizontally across the backrest 12 spanning the slots 22, and in doing so, may form bridges 26. The reinforcing ribs 24 may be integrally molded with the backrest 12. The reinforcing ribs 24 shown start about one-third of the way up the backrest 12, although another starting point may be suitable for carrying out the invention. Towards the bottom of the backrest 12, the reinforcing ribs 24 may be clustered closer together than towards the top, although such clustering may be an optional characteristic. Outside the slots 22 in the wings 20 of the backrest 12, horizontal slots 28 may alternate with the ribs 24.

Beyond the upper ends of the slots 22, there may be more slots, such as the upper slots 30 shown. These slots 30 may extend down from the upper edge of the backrest 12, and may include, for example, two outer slots and one central slot, which is slightly longer than two outer slots, and which may be just inward of the slots 22.

On the rear face of the backrest 12, in the central zone 32 of the backrest 12 between the slots 22, there may be fixing points, such as the four fixing points 34 shown, where the backrest 10 may be attached to the adjustable support 14. The arrangement of the fixing points 34 may be symmetrical with respect to a vertical center line of the backrest 12, with one pair near the top of a central zone 32 of the backrest and another pair near the bottom of the central zone 32. The fixing points 34 of each pair may be quite close together so that the backrest 12 can be secured to the adjustable support 14 at a narrow interface with the backrest 12, whereby the adjustable support 14 may be a narrow supporting spine or frame supported from the rear of the seat assembly 10. While these fixing points 34 may be fixed, the rest of the backrest 12 can move slightly under the constraints imposed by the stiffness of the backrest material and the ribs 24 and the amount of freedom allowed by the slots 22. But, in particular, there is a capacity to "ripple" or alter the curvature of the backrest 10 from top to bottom or vice versa by adjusting the adjustable support 14, as will become more apparent in the description that follows, and fix the backrest 10 in place, thus shaping the backrest 12 and the seatback assembly 10.

Figure 2:
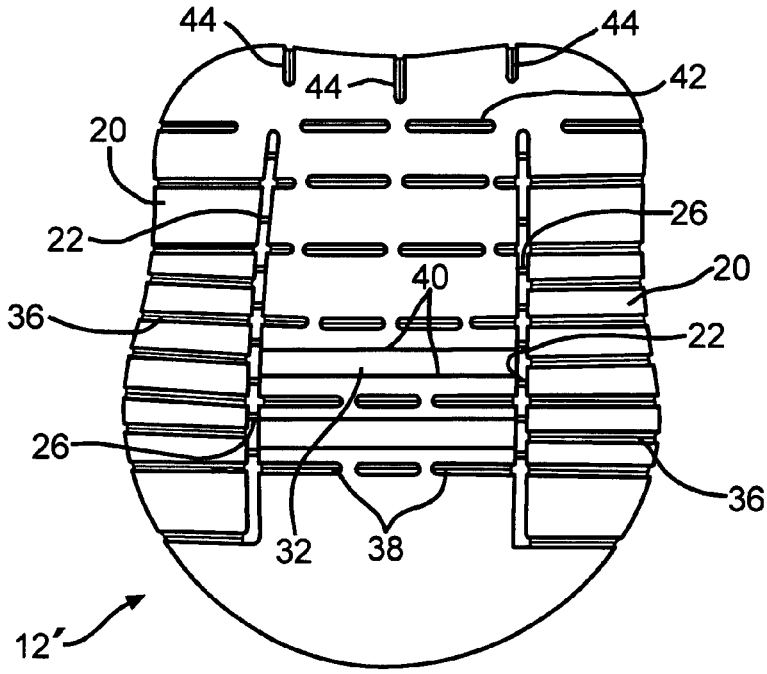
FIG. 2 is a front elevational view of an alternative backrest generally having webs instead of slots.
Figure 3:
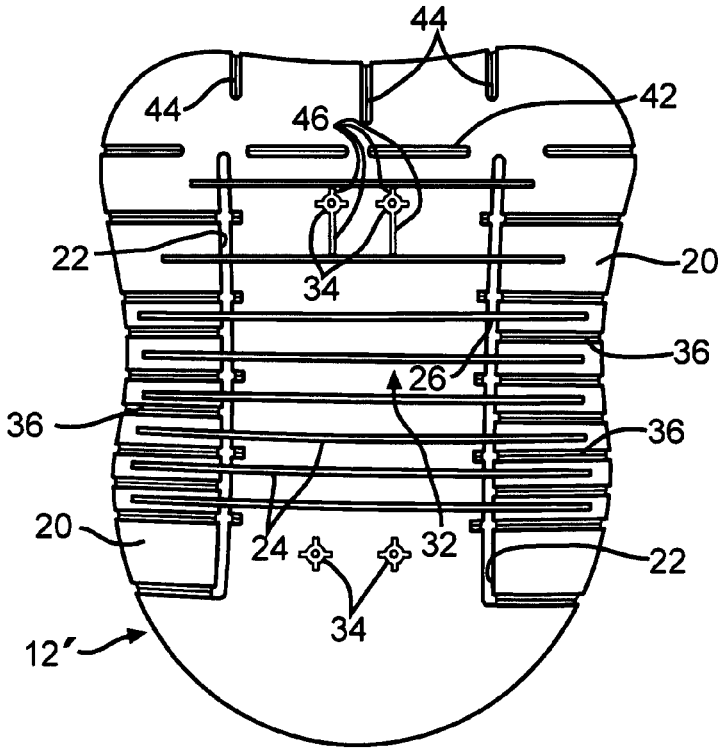
FIG. 3 is a rear elevational view of the alternative backrest shown in FIG. 2.

An alternative backrest 12' is illustrated in perspective views shown in FIGS. 2 and 3, with similar parts similarly referenced. Much of the difference lies in having webs 36 and 44 instead of the slots 28 and 30 and in adding webs 38 and 42 and scored lines 40. For example, horizontal webs or elongate membranes 36 may alternate with the ribs 24. The webs 36 may be created by thinning and/or corrugating material on both sides of the backrest 12'. Webs 38 may also be provided in a central zone 32 of the backrest 12' between the slots 22. These webs 38 may be created by the provision of horizontal grooves in the front side of the backrest 12'. The webs 38 may be discontinuous, and may further be aligned with some of the webs 36 between the ribs 24. Between the webs 38, over part of the central zone 32, lines 40 may be scored parallel to the webs 38 in the backrest 12', whereby the lines 40 may give a bit of extra flexibility.

Beyond the upper ends of the slots 22, there may be another intermittent web 42, which may be visible on both sides of the backrest 12', and above the intermittent web 42, there may be more webs or elongate corrugated membranes 44 extending down from the upper edge of the backrest 12', for example, one central and slightly longer than the two others, which may be just inward of the slots 22.

Although it is not necessary for practicing the invention, the former backrest 12 may give greater flexibility to the lower part of the central zone 32, with the upper part remaining relatively stiff, as compared to the latter backrest 12'. While the lower part may ripple quite easily, the upper part may have more limited capacity to deform. To maintain these different characteristics between the upper and lower parts, the material of the upper part could be thicker than that of the lower part, or, as shown in FIG. 3, at least some of the ribs 24 spanning the upper part may be joined by further vertical ribs 46, which may be substantially symmetrical with respect to the vertical center line of the backrest 12'. The vertical ribs 46 shown extend between the two uppermost reinforcing ribs 24 and incorporate the upper fixing points 34, which may also be incorporated in a short transverse rib. This may reinforce the backrest 12' in the upper zone of attachment. There may be similar reinforcement in the lower zone. Such vertical ribs 46 may have a very short vertical extent and thus should not affect the ability of the backrest 12' to ripple above the second lowermost reinforcing rib 24.

It will be understood that the number, size and distribution of ribs 24, slots 22 and 28, webs 36, 38, 42 and 44, and lines 40 can vary from what is shown, to tailor the flexibility of the backrests 12 and 12' with some precision. It should also be understood that the slots 22, though shown as straight and parallel, may be varied, for example by having them slightly divergent or curved.

Figure 4:
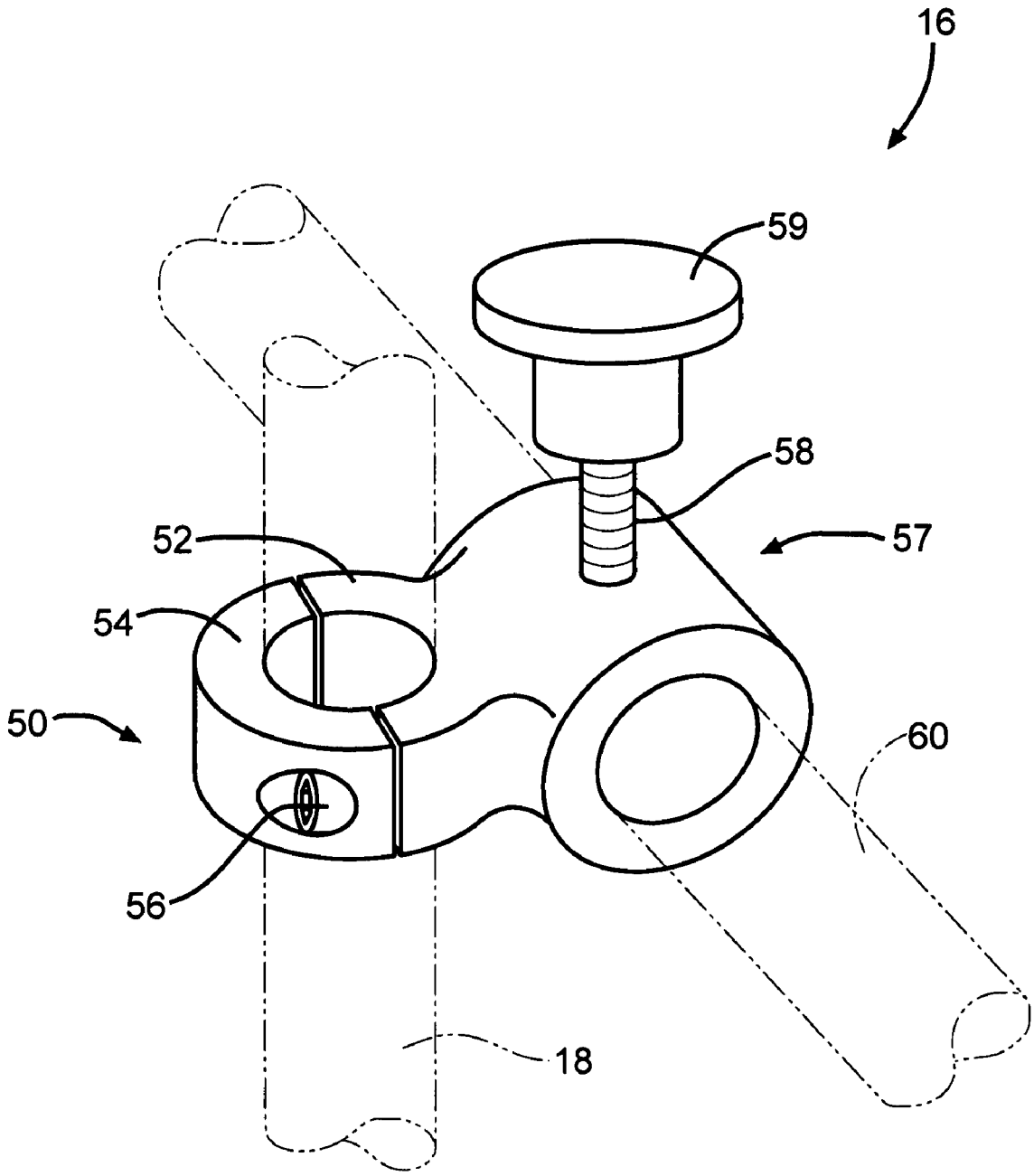
FIG. 4 is an enlarged perspective view of a coupling for attaching a seatback assembly to a rigid support.

Referring back to FIG. 1, the seatback assembly 10 is attached to a rigid support 18, which may be in the form of laterally spaced seatback posts or canes, or a single supporting spine or narrow frame, upstanding from the rear of the seat. The seatback assembly 10 may be attached in any suitable manner, such as, for example, by the coupling 16 shown in the enlarged perspective view in FIG. 4. It should be understood that this coupling 16 is shown for exemplary purposes and that other couplings, or other forms of fasteners, may be suitable for carrying out the invention.

The coupling 16 may have a first coupling element 50 that may be in the form of a tube clamp, which is structured to clamp the coupling 16 to the laterally spaced seatback posts, or other suitable rigid support 18. Such an element 50 may be structured to be separated into parts 52, 54, which can be joined together and tightened upon the rigid support 18 by cap screws, or other suitable fasteners 56. Upon loosening the fasteners 56, the coupling element 50 can be adjusted relative to the rigid support 18, such as by raising or lowering the coupling element 50 relative to the rigid support 18.

A second coupling element 57 may be in the form of a tube clamp as well. This coupling element 57 is structured to support the adjustable support 14 for pivotal movement about a laterally extending axis. Such an element 57 may be in the form of a collar having a threaded member 58 passing therethrough. The threaded member 58 may be provided with a knob 59, which functions as a hand grip for conveniently tightening and loosening the threaded member 58 by hand, without the aid of tools. Upon loosening the threaded member 58, the adjustable support 14 may be pivoted about the laterally extending axis to change the general orientation of the adjustable support 14. Once a desired orientation has been achieved, the threaded member 58 can be tightened into engagement with the adjustable support 14 so that the adjustable support 14 is prevented from pivoting relative to the coupling element 57. The effect of this pivotal adjustment will become clear in the description that follows.

Figure 5:
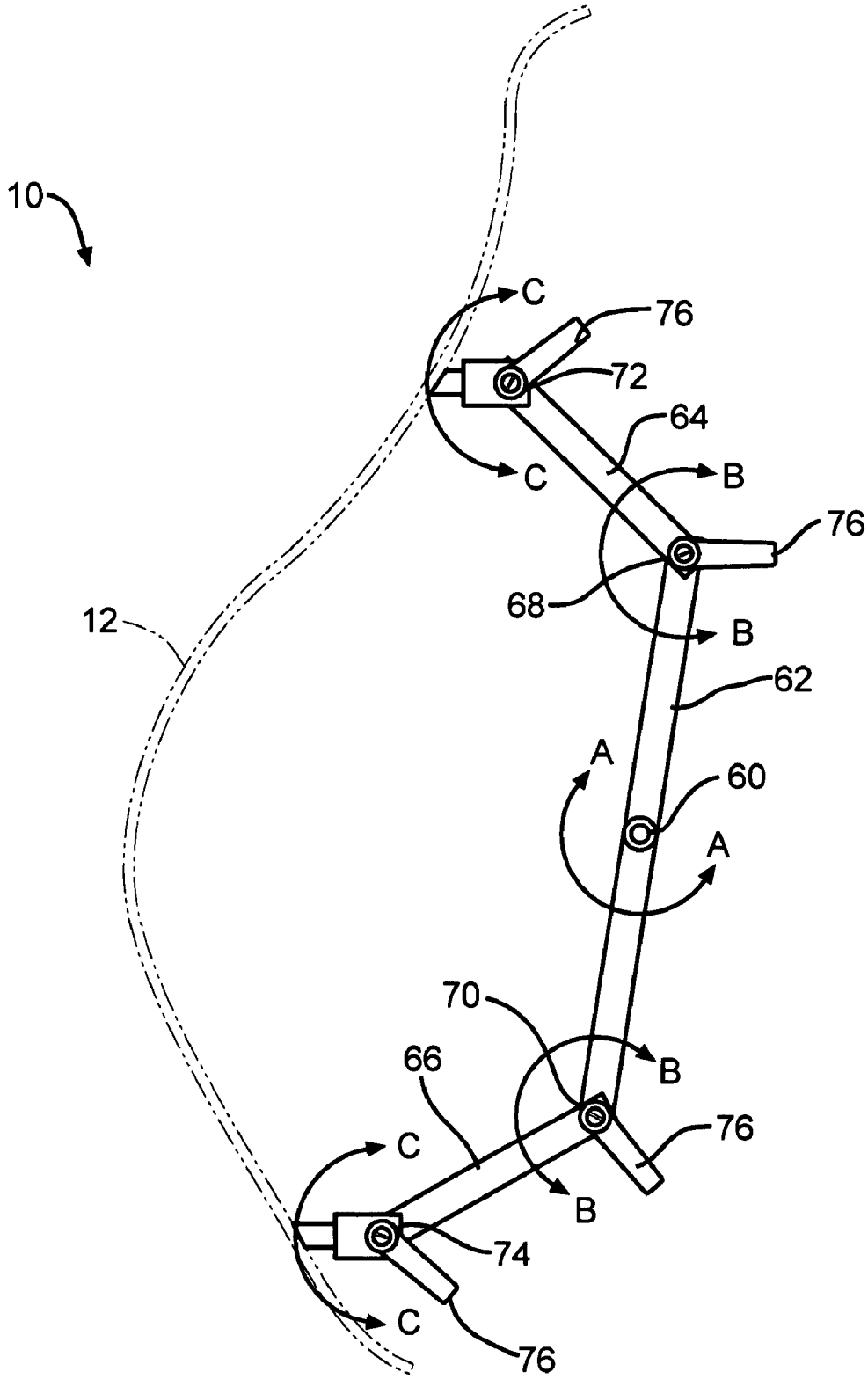
FIG. 5 is a side elevational view of an adjustable support for shaping the backrest.
Figures 6, 7, 8, 9:
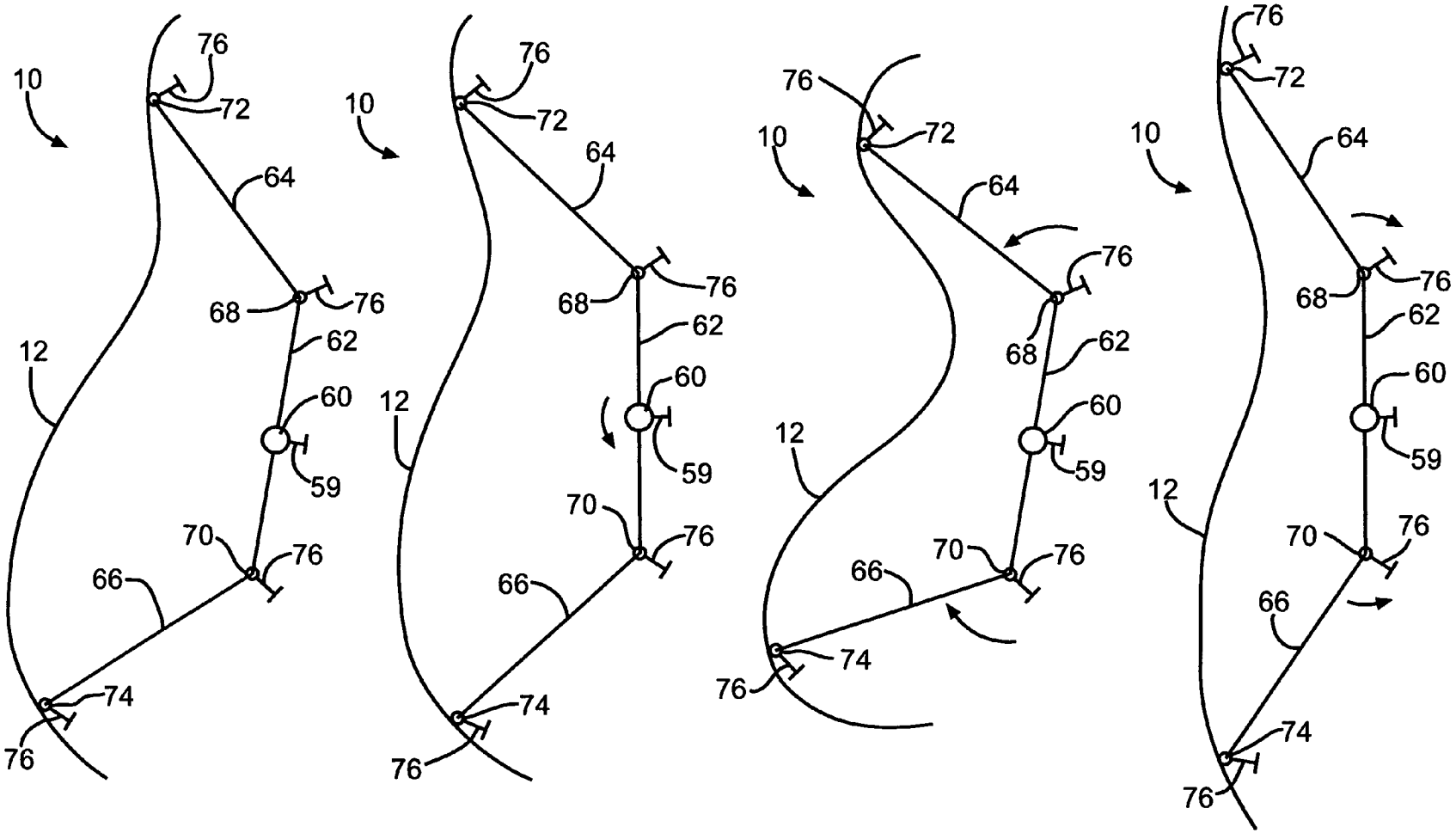
FIGS. 6-9 are diagrammatic representations of the seatback assembly in alternative positions.

Now, with reference to FIG. 5, there is illustrated a side elevational view of an adjustable support 14. The support 14 generally includes a primary support member 60, a secondary support member 62, tertiary support members 64, 66, and couplings 68, 70, 72, 74.

The primary support member 60 extends laterally relative to the rigid support 18 and is supported for pivotal movement by one or more couplings 16. The secondary support member 62 extends transversely, perpendicularly or otherwise, from the primary support member 60, and may be supported in fixed relation to the primary support member 60 so that upon pivoting the primary support member 60, the secondary support member 62 pivots along the line A-A in FIG. 5. Alternatively, the primary support member 60 may be held in a fixed position and the secondary support member 62 may pivot in relation to the fixed primary support member 60.

The tertiary support members 64, 66 extend forwardly from the secondary support member 62. Although two tertiary support members 64, 66 are shown, one member 64, 66 may be suitable for carrying out the invention. The tertiary support members 64, 66 may be coupled at one end for pivotal movement along the lines B-B relative to the secondary support member 62 and at another end to the backrest fixing points 34 to permit pivotal movement of the backrest 12 along the lines C-C. In the exemplary embodiment shown, an upper tertiary support member 64 is coupled to an upper end of the secondary support member 62 and a lower tertiary support member 66 is coupled to a lower end of the secondary support member 62.

The tertiary support members 64, 66 are coupled to the secondary support member 62 by a first set of couplings 68, 70 and to the backrest fixing points 34 by a second set of couplings 72, 74. The couplings are structured to be tightened to prevent the tertiary support members 64, 66 from pivoting relative to the secondary support member 62 and prevent the backrest 12 from pivoting relative to the tertiary support members 64, 66. Each coupling, for example, may be in the form of a threaded fastener that, when tightened, applies a clamping force between the tertiary support members 64, 66 and the secondary support member 62 and between the backrest 12 and the tertiary support members 64, 66 to prevent pivotal movement. The threaded fasteners may be provided with a knob or lever 76, which functions as a hand grip for conveniently tightening and loosening the threaded fastener by hand, without the aid of tools. Alternatively, the couplings may be comprised of a cam lever that is displaceable to apply a clamping force. It should be understood that these are merely examples of couplings that may be suitable for practicing the invention and that the invention may be practiced with other couplings.

The operation of the shapeable wheelchair seatback assembly 10 is best understood with reference to the diagrammatic representations shown in FIGS. 6-9. By comparing FIGS. 6 and 7, it should be clear that pivotal movement of the secondary support member 62 (i.e., along the line A-A when viewing FIG. 5) has the effect of causing general fore and aft movement of the upper and lower portions of the backrest 12. Pivotal movement of tertiary support members 64, 66 relative to the secondary support member 62 (i.e., along the lines B-B when viewing FIG. 5) has the effect of causing general vertical movement of the upper and lower portions of the backrest 12. Pivotal movement of backrest 12 relative to the tertiary support members 64, 66 (i.e., along the lines C-C) has the effect of causing angular movement of the upper and lower portions of the backrest 12. By combining various pivotal movements, the backrest 12 can be shaped as desired. Once a desired shape is achieved, the couplings can be tightened to fix the backrest 12 in position.

It should be appreciated that the exemplary shapeable seatback assembly 10 may be described in terms of a four bar assembly, wherein the four bars comprise three support members, like the secondary and tertiary support members, and a flexible backrest, all pivotally moveable relative to one another and configured to be fixed in a desired position.

It should be also appreciated that the shapeable seatback assembly 10 shown and described herein is an exemplary assembly. The invention is not limited to the assembly shown and described above. For example, one or more couplings may be provided for effecting pivotal movement to shape the backrest accordingly and that all the couplings shown and described need not be necessary for practicing the invention.

It should further be appreciated that the invention is not limited to the primary, secondary and tertiary support members shown but may be practiced with more or less support members than shown and described. For example, though not shown, the invention may be practiced with other support members, which are pivotally movable, similar to the support members described above, and corresponding couplings that function to fix the support members in place.

Although the support members are not described in detail, the support members may take on any suitable shape and may be configured in any suitable manner. For example, the invention is not intended to be limited to the linear support members shown but instead may be practiced with curved support members. Moreover, each support member may be in the form of a tubular member, or a single or multi-leaf member, wherein the multi-leaf members may include plural leafs held in spaced relation by spacers.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A seatback assembly for use on a wheelchair comprising:

a backrest comprising shapeable material; and an adjustable support having a plurality of support members that are connected together by a plurality of support member couplings, the plurality of support members and the backrest being arranged to form a four-bar linkage that is pivotally connected to a wheelchair frame, the backrest being attached to the adjustable support, each of the plurality of support members being pivotally adjustable relative to the backrest and the other support members by the plurality of support member couplings in order to alter the curvature of the backrest from top to bottom, the support member couplings being configured to be moved from an unlocked position to a locked position to fix the backrest in place with the support member couplings, thus shaping the backrest.

2. A seatback assembly of claim 1 wherein the backrest has the general shape of a shield bowed in a forward direction, and comprises side wings curving in a forward direction, zones of weakness extending vertically one proximate each side of a vertical center line and stopping short of top and bottom edges of the backrest, and reinforcing ribs extending horizontally across the backrest spanning the zones of weakness so as to form bridges.

3. A seatback assembly of claim 1 wherein the backrest is attached to the adjustable support at fixing points that are generally symmetrical with respect to the vertical center line of the backrest, with one pair of fixing points near a top of a central zone of the backrest and another pair of fixing points near a bottom of the central zone.

4. A seatback assembly of claim 3 wherein each pair of fixing points is close together so that the backrest can be secured to the adjustable support at a narrow interface with the backrest, the adjustable support being in the form of a narrow supporting spine.

5. A seatback assembly of claim 1 further comprising a coupling for attaching the seatback assembly to a rigid support of a wheelchair seat system.

6. A seatback assembly of claim 5 wherein the rigid support is in the form of a single supporting spine upstanding rearward from the seat system.

7. A seatback assembly of claim 5 wherein the rigid support is in the form of laterally spaced seatback posts upstanding rearward from the seat system.

8. A seatback assembly of claim 5 wherein the coupling has a first coupling element that is structured to clamp the coupling to the rigid support, the coupling being vertically adjusted relative to the rigid support, and a second coupling element that is structured to support the adjustable support for pivotal movement about a laterally extending axis.

9. A seatback assembly of claim 1 wherein the adjustable support includes a primary support member that extends laterally relative to the rigid support and a secondary support member that extends transversely from the primary support member, the secondary support member being pivotable about a lateral axis.

10. A seatback assembly of claim 9 wherein the adjustable support includes at least one tertiary support member that extends forwardly from the secondary support member, the tertiary support member being coupled at one end to the secondary support member and at another end to the backrest, at least one of the two ends of the tertiary support member permitting pivotal movement of the tertiary support member or the backrest.

11. A seatback assembly of claim 9 wherein the adjustable support includes at least one tertiary support member that extends forwardly from the secondary support member, the tertiary support member being coupled at one end for pivotal movement to the secondary support member and at another end for pivotal movement to the backrest, the two ends of the tertiary support member each permitting pivotal movement of the tertiary support member or the backrest.

12. A seatback assembly of claim 9 wherein the adjustable support includes two tertiary support members that extend forwardly from the secondary support member, the tertiary support members each being coupled at one end to the secondary support member and at another end to the backrest, at least one of the two ends of the tertiary support members permitting pivotal movement of the tertiary support members or the backrest.

13. A seatback assembly of claim 9 wherein the adjustable support includes two tertiary support members that extend forwardly from the secondary support member, the tertiary support members each being coupled at one end for pivotal movement to the secondary support member and at another end for pivotal movement to the backrest, the two ends of the tertiary support members each permitting pivotal movement of the tertiary support members or the backrest.

14. A seatback assembly of claim 9 wherein an upper tertiary support member is coupled to an upper end of the secondary support member and a lower tertiary support member is coupled to a lower end of the secondary support member, the tertiary support members being coupled to the secondary support member by a first set of couplings and to the backrest by a second set of couplings, the couplings being structured to be loosened to permit pivotal movement of the tertiary support members and the backrest and tightened to prevent the tertiary support members from pivoting relative to the secondary support member and to prevent the backrest from pivoting relative to the tertiary support members.

15. A seatback assembly of claim 9 wherein each set of couplings includes a threaded fastener that, when tightened, applies a clamping force between the tertiary support members and the secondary support member and between the backrest and the tertiary support members to prevent pivotal movement.

16. A seatback assembly of claim 15 wherein the threaded fasteners are provided with a hand grip for conveniently tightening and loosening the threaded fastener by hand, without the aid of tools.

17. A seatback assembly of claim 15 wherein each set of couplings includes a cam lever that is displaceable to apply the clamping force.

18. A seatback assembly for use on a wheelchair comprising:

a backrest comprising shapeable material; and an adjustable support having a plurality of support members arranged in a four-bar linkage configuration and pivotally connected by support member couplings wherein the plurality of support members are pivotally moveable relative to each other and the four-bar linkage is pivotally adjustable as a unit relative to a wheelchair frame, the backrest being attached to the adjustable support, the adjustable support being adjustable to alter the curvature of the backrest from top to bottom and the support member couplings being configured to move from an unlocked position to a locked position to fix the backrest in place, thus shaping the backrest.

19. A seatback assembly for use on a wheelchair comprising:

a backrest comprising shapeable material; and an adjustable support having a secondary support member and a tertiary support member that are pivotally adjustable relative to each other, the backrest being pivotally attached to the adjustable support such that the backrest, the secondary support, and the tertiary support pivotally connected by support member couplings that cooperate to form a four-bar linkage, the support member couplings being configured to be moved from an unlocked position to a locked position to define and fix a curvature of the backrest, the adjustable support being adjustable to provide a range of adjustment to alter the curvature of the backrest from top to bottom and then fix the backrest in place, thus shaping the backrest.

20. The seatback assembly of claim 19 wherein the adjustable support includes a second tertiary support member that is pivotally connected to the secondary support member and the adjustable support is pivotally connected to a primary support.

* * * * *